United States Patent [19]

Clancy et al.

[11] Patent Number: 4,604,509

[45] Date of Patent: Aug. 5, 1986

[54] ELASTOMERIC PUSH BUTTON RETURN ELEMENT FOR PROVIDING ENHANCED TACTILE FEEDBACK

[75] Inventors: Kevin F. Clancy; Ralph J. Schneider, both of Freeport, Ill.

[73] Assignee: Honeywell Inc., Minneapolis, Minn.

[21] Appl. No.: 697,294

[22] Filed: Feb. 1, 1985

[51] Int. Cl.[4] ..... H01H 3/12

[52] U.S. Cl. ..... 200/159 B; 200/340

[58] Field of Search ..... 200/159 B, 340; 400/491.3

[56] References Cited

U.S. PATENT DOCUMENTS

| | | | |
|---|---|---|---|
| 3,478,857 | 11/1969 | Linker | 400/491.2 |
| 3,767,022 | 10/1973 | Olson | 400/481 |
| 4,378,478 | 3/1983 | Deeg | 200/159 B |
| 4,390,765 | 6/1983 | Sado | 200/159 B |
| 4,531,033 | 7/1985 | Schmid et al. | 200/159 B |

FOREIGN PATENT DOCUMENTS

| | | | |
|---|---|---|---|
| 2902892 | 8/1979 | Fed. Rep. of Germany | 200/159 B |
| 2103882 | 2/1983 | United Kingdom | 200/159 B |
| 2112577 | 7/1983 | United Kingdom . | |

*Primary Examiner*—Stephen Marcus
*Assistant Examiner*—Renee S. Luebke
*Attorney, Agent, or Firm*—Charles L. Rubow

[57] ABSTRACT

An elastomeric push button return element for providing enhanced tactile feedback, and a push button switch employing the return element. The return element is configured as a tubular section, a flange adapted to be restrained on a mounting surface, a radial web thinner than the wall of the tubular section joining the flange and a first end of the tubular section, a hollow frustum section joined at its large end to the second end of the tubular section, and a crown joined to the small end of the hollow frustum section and adapted to be connected to a push button.

23 Claims, 5 Drawing Figures

ELASTOMERIC PUSH BUTTON RETURN ELEMENT FOR PROVIDING ENHANCED TACTILE FEEDBACK

BACKGROUND OF THE INVENTION

The invention described herein relates generally to push buttons having nonlinear force/displacement characteristics, and more particularly to elastomeric push button return elements for providing enhanced tactile feedback.

Push buttons are widely used as switch actuators in keyboard terminals and a variety of other switch devices. A push button actuator typically employs some form of resilient element to bias the button toward its unactuated position. The simplest forms of resilient return elements typically provide a linear force/displacement characteristic. However, it is well known that a nonlinear characteristic may be advantageous in certain applications. Specifically, it may be desirable for the push button to exhibit a characteristic in which displacement force initially increases with displacement to a predetermined displacement value, and thereafter decreases with displacement. Such a characteristic may provide both more positive actuation of the switch or other device actuated by the push button, and tactive feedback indicating actuation of the switch or other device. These functions are desirable in keyboard and other applications.

Particularly in keyboards intended for high input rates over extended periods of time, the tactile characteristics of the push button keys become a major factor in mental and physical fatigue of the operator, and operator speed and accuracy. It it generally accepted that the optimum operating force for a high speed keyboard push button is in the range of 40 to 100 grams. It is further generally accepted that the length of the push button stroke before the breakover point in the force/displacement characteristic is an important factor in operator comfort. A push button stroke of 1.0 to 1.8 mm before the breakover point is regarded as the most desirable.

Other desirable characteristics or requirements of particularly a keyboard push button actuator include smooth and quiet operation, at least somewhat cushioned stops at the ends of push button travel, and long life. In addition, it is required that general purpose push button actuators be inexpensive, which translates into a requirement for a small parts count, parts made of inexpensive material, and ease of assembly. Finally, there are definite constraints on size. Keyboard designs have largely standardized on key spacing of 0.75 inches center to center, and the trend is toward increasingly low profile keyboard assemblies.

Aesthetically, it has been found desirable for keyboard keys to have a somewhat square configuration such that an array of keys substantially completely covers the underlying support panel, and to have sufficient apparent depth to conceal mechanisms other than the key tops mounted thereon. This has been accomplished with a key cap design having a substantially square top with a flaired skirt. In order to meet the low profile requirement, the push button mechanism, including any resilient return element therein, must fit within the skirt when the key cap is depressed. The fixed key spacing and the low profile requirements limit the space available for the push button mechanism, and consequently for the return element. As a result, both the mechanism and the return element must be exceptionally compact.

Return elements involving elastomeric dome configurations have been found to offer considerable potential in meeting the previously discussed requirements. A variety of elastomeric dome configurations for this purpose have been devised. One of the problems encountered with compact prior elastomeric dome designs is less than optimum deflection before the breakover point in the force/deflection characteristic. This problem is addressed in U.S. Pat. No. 4,390,765 issued to R. Sado, et al on June 28, 1983 in which is shown a dome design comprising an annular cylindrical portion and a hollow truncated cone portion arranged so that the junction between the two portions expands radially by a predetermined amount before the cone portion undergoes buckling deformation. Previous versions of a somewhat similar design are known from U.S. Pat. Nos. 3,478,857 issued to J. Linker on Nov. 18, 1969 and 3,767,022 issued to C. Olson on Oct. 23, 1973. U.S. Pat. No. 4,378,478 issued to R. Deeg on Mar. 29, 1983 and British patent application No. 2,112,577 published on July 20, 1983 also disclose elastomeric dome return elements having some general similarities to the previously described elements. The latter patent and application are of further interest in connection with the present invention for their showings of designs in which a radially extending flange surrounding and joined to the annular portion is formed with an annular groove at the location of the intersection between the flange and annular portion.

Although a variety of elastomeric dome return element designs have been devised in attempts to provide improved tactile characteristics for keyboard push buttons, none of the prior designs is optimally characterized in all respects. The applicants have devised a unique elastomeric dome return element design which provides specific improvements in the tactile characteristics achievable with a compact element, while continuing to meet the other important structural and operational requirements.

SUMMARY OF THE INVENTION

The present invention is a compact elastomeric push button return element which basically comprises a hollow member including a tubular section with a hollow frustum section at one end and a radially extending flange at the other end. The flange is formed with an annular groove at its junction with the tubular section so as to form a radially extending web between the flange and the section. The tubular section and the web are characterized so that the web is more flexible than the tubular section. This may be accomplished by forming the tubular section with a wall thickness greater than the thickness of the web. The frustum section may be formed with a wall thickness which is a minimum at an intermediate location and increases toward either end. The small end of the frustum section is adapted to be connected to a push button through a crown which includes a tubular wall terminating in a shoulder against which an end of the push button is positioned, a stop within the hollow member at substantially the same radius as the shoulder, and an actuator button joined to the remainder of the crown through a resilient cup shaped section.

DESCRIPTION OF THE PREFERRED EMBODIMENT

Figure 1:
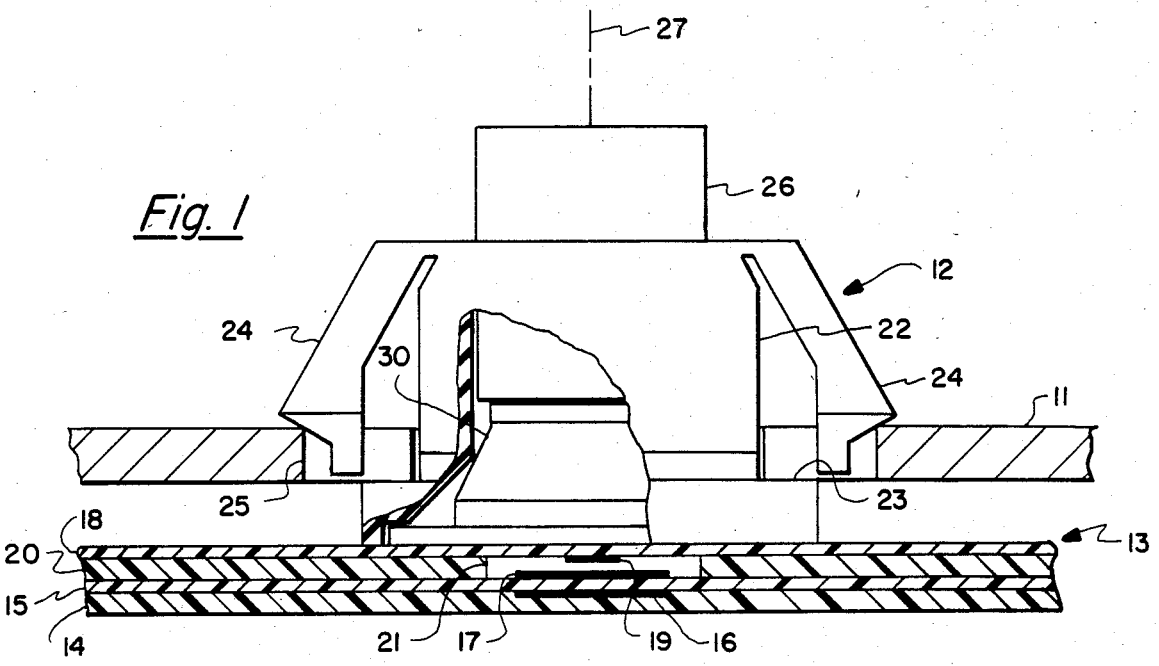
FIG. 1 is an enlarged side view of a section of a keyboard with a push button switch actuator (shown partially broken away and without a key cap) in accordance with the applicants' invention.

Illustrated in FIG. 1 is a single key station of a capacitive membrane keyboard having a plurality of such stations. The keyboard includes a rigid push button support plate or base 11 on which are mounted a plurality of push button actuators, such as generally identified by reference numeral 12. Reference numeral 13 generally identifies a membrane switching assembly which is shown as employing capacitive switches of a type disclosed in detail in U.S. Pat. No. 4,359,720 issued to T. Chai, et al on Nov. 16, 1982 and assigned to the same assignee as the present application. Although a capacitive switch assembly is shown for illustrative purposes, actuator 12 may be used equally advantageously with other suitable switches, such as those involving only electrical contact switching.

Briefly, membrane switch assembly 13 comprises a rigid substrate or backing plate 14 mounted in a fixed relationship with respect to support plate 11. Mounted directly on substrate 14 is a first dielectric membrane 15 having a pair of electrically conductive areas 16 and 17 formed on opposite sides thereof. Reference numeral 18 identifies a second dielectric membrane having a conductive area 19 formed on the surface thereof nearest conductive area 17. A spacer sheet 20 is interposed between membranes 15 and 18 to normally maintain a separation between conductive areas 17 and 19.

Spacer sheet 20 is provided with apertures 21 at the locations of conductive areas 17 and 19, and membrane 18 is flexible so as to permit the spacing between conductive areas 17 and 19 to be varied. Conductive areas 16, 17 and 19 form plates of a capacitor of which the outer plates are connected to electrical drive and detection circuitry. The capacitance of the capacitor can be varied by push button actuator 12 as will be described hereinafter, and the capacitance can be sensed to determine the actuation state of the push button switch.

In the illustrated membrane switch assembly, conductive areas 17 and 19, in fact, come into electrical contact upon depression of plunger 26 for purposes described in previously identified U.S. Pat. No. 4,359,720. In further connection with the keyboard illustrated in FIG. 1, a capacitive switch including plates such as conductive areas 16, 17 and 19 is located at each key station. Each switch is actuated by a separate push button actuator such as identified by reference numeral 12.

Actuator 12 includes a housing 22 which, for mounting purposes, is formed with a flange 23 and a pair of oppositely disposed resilient projecting arms 24. Accordingly, housing 22 may be inserted through a mounting hole 25 in support panel 11, and snapped in place with flange 23 against the bottom surface of the panel. Projections on arms 24 pass through the mounting hole and snap outwardly to hold actuator 12 in place.

Figure 2:
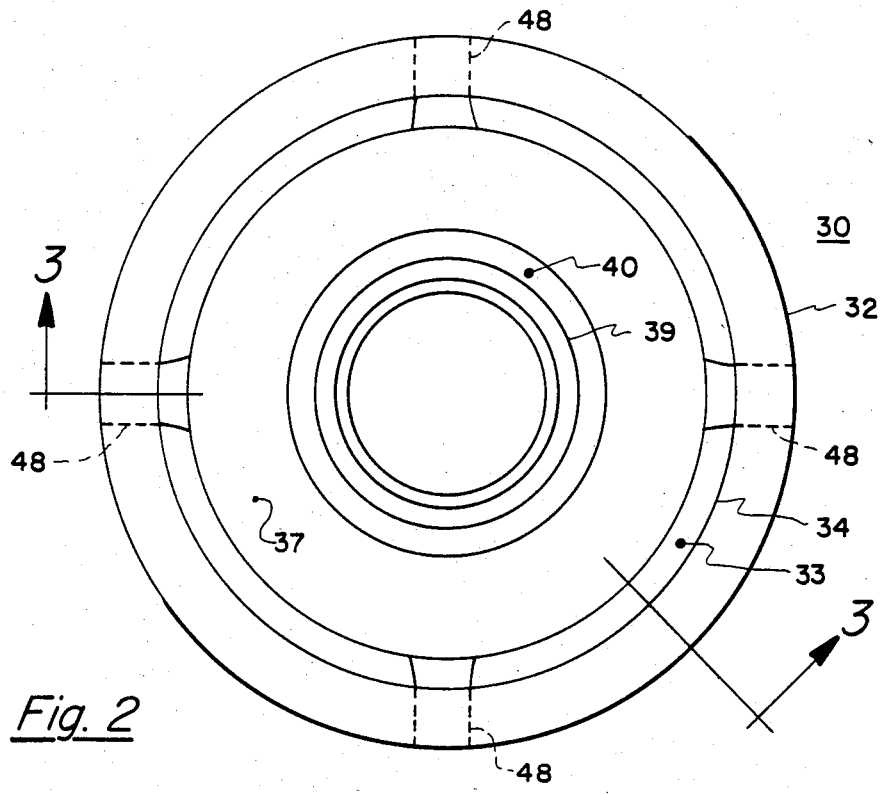
FIG. 2 is a plan view of an elastomeric push button return element in accordance with the applicants' invention used in the push button actuator of FIG. 1.
Figure 3:
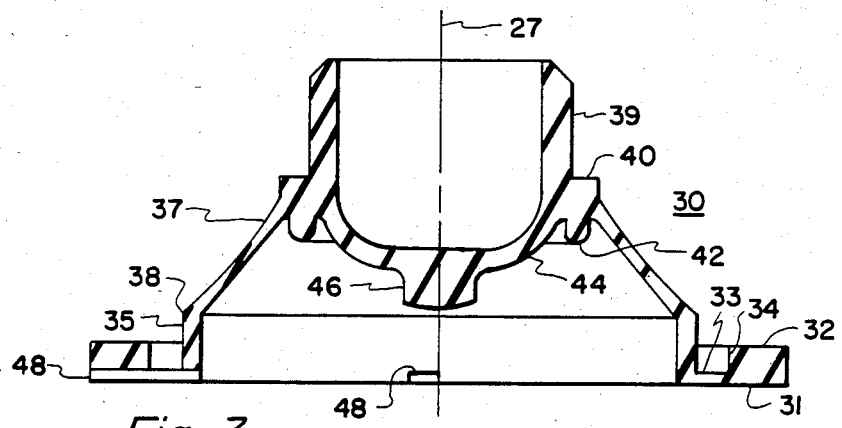
FIG. 3 is a sectional side view of the elastomeric push button return element of FIG. 2 taken along lines 3—3, with the element in its uncompressed state.

A plunger 26 is confined in housing 22, and is adapted for movement along an axis 27. A key cap (not shown) is normally mounted on plunger 26 to facilitate depression thereof by a keyboard operator. Located between plunger 26 and the upper surface of switching assembly 13 is an elastomeric push button return element 30 in accordance with the applicants' invention as shown in greater detail in FIGS. 2–4.

Element 30 is of a unitary configuration and molded of elastomeric material. As illustrated, element 30 is of generally circular configuration, symmetrical with respect to axis 27. Element 30 basically comprises a flange 31 having an annular outer portion 32 adapted to be held against the upper surface of switching assembly 13 (see FIG. 1) by housing 22. Flange 31 also includes an annular portion of reduced thickness or radial web 33 created by a groove 34 in the upper surface of the flange.

A cylindrical tubular section 35 is connected at its lower end to web 33. For purposes which will hereinafter be described, web 33 and tubular section 35 are characterized so that web 33 is more flexible than section 35. For this purpose, the wall thickness of section 35 may be greater than the thickness of web 33.

At the other end of tubular section 35 is a hollow frustum section 37 joined at its large end to the end of section 35 remote from web 33, the junction area being identified by reference numeral 38. As illustrated, hollow frustum section 37 has a wall thickness which varies with distance along axis 27. More specifically, the wall thickness of frustum section 37 is greater at the ends of the section than at intermediate locations therealong.

Joined to the small end of frustum section 37 is a crown comprising a tubular wall 39 sized to fit snuggly into an aperture in plunger 26. When plunger 26 and element 30 are in place, the lower end of the plunger is positioned against an external shoulder 40 on wall 39.

Within frustum section 37 at substantially the same radius as shoulder 40 is an annular stop member 42 which extends downwardly a short distance. Within stop member 42 and joined to wall 39 is a cup shaped section 44 having a downwardly projecting actuator button 46 at the center thereof. As shown, actuator button 46 is formed so that it normally projects downwardly further than stop member 42, and thus comes into contact with the upper surface of switching assembly 13 before stop member 42 as plunger 26 is depressed. The hollow interior of element 30 is vented through passageways 48 so as to prevent a buildup of air pressure as plunger 26 is depressed which might otherwise interfere with proper operation of the actuator and/or switching assembly.

Figure 4:
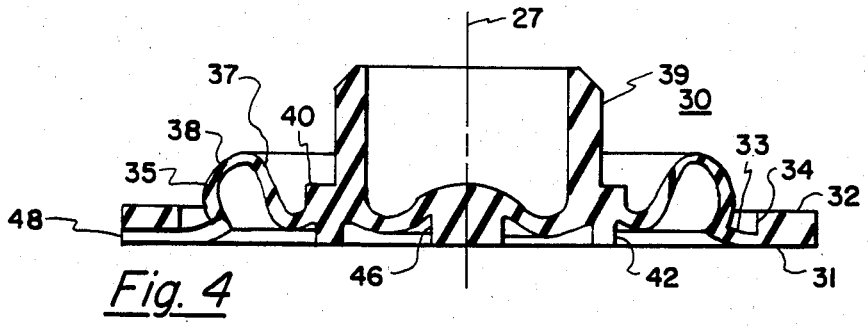
FIG. 4 is a sectional side view of the elastomeric push button return element of FIG. 2, with the element in its compressed state.

Referring to FIG. 4, as element 30 is compressed, junction area 38 between tubular section 35 and frustum section 37 first expands radially. As this expansion occurs, web 33 is curled upwardly. After a predetermined depression of plunger 26, frustum section 37 buckles into an S-shaped cross section as shown in FIG. 4. The nonuniform wall thickness of frustum section 37 provides for buckling into a cross sectional configuration of fairly uniform radii. This eliminates sharp bends and reduces stresses in the wall of section 37, thereby increasing the life of the element 30.

Figure 5:
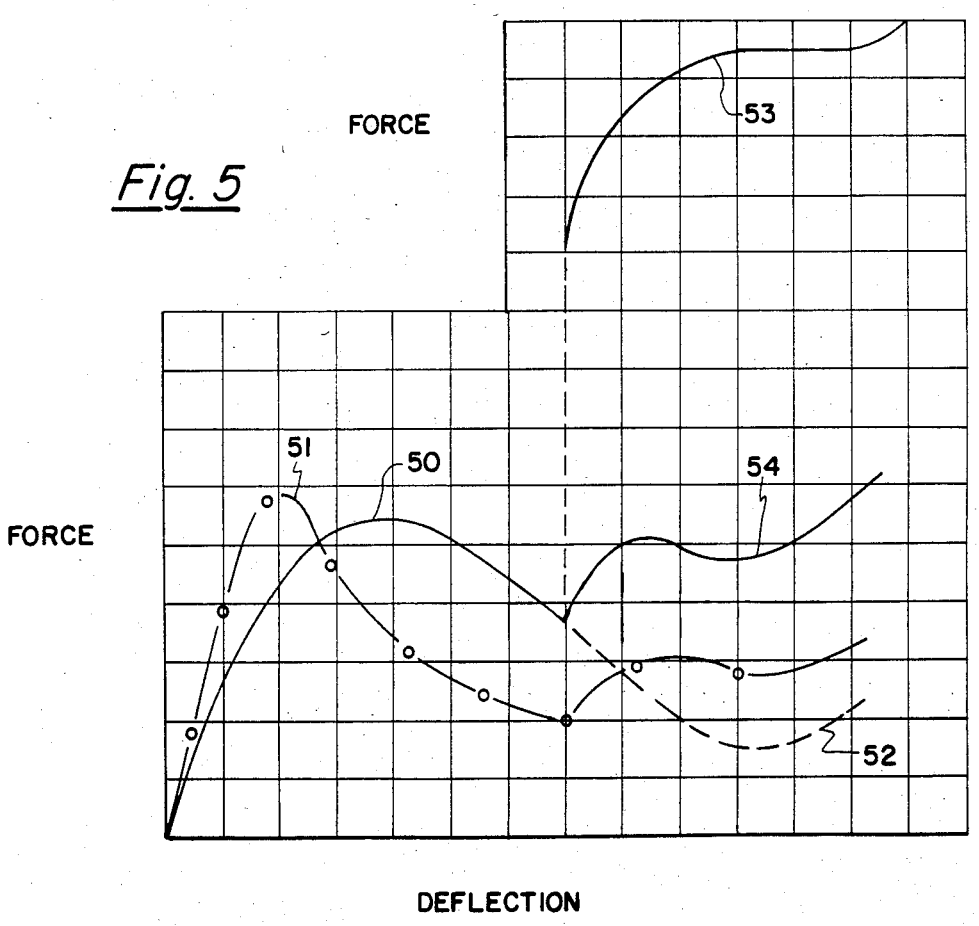
FIG. 5 is a graph illustrating the force/deflection characteristic of the elastomeric push button return element of FIGS. 2–4.

In FIG. 5, curves 50 and 51 respectively illustrate the force/deflection characteristics of element 30 and an element which is identical thereto except for elimination of groove 34. As shown by curve 51, without groove 34, the force required for small deflections rises rapidly to a peak value and then falls off rapidly. The breakover point occurs at a smaller than optimum deflection. The portion of the curve to the left of the breakover point results primarily from radial expansion of tubular section 35.

The slope of the force/deflection curve is primarily a function of the wall thickness and wall length of section 35. Generally, the slope is decreased by reducing the wall thickness and by increasing the wall length. It follows that, if it is desired to move the breakover point on the force/deflection curve to a greater deflection, the wall thickness of section 35 should be decreased and/or its length should be increased. However, there are constraints which prevent such alterations from being extended to thickness and length values sufficient to achieve the desired deflection at the breakover point. Specifically, because of height limitations on the push button actuator, it may not be possible to sufficiently increase the length of tubular section 35. Conversely, decreasing the wall thickness tends to result in a peak force which is less than desired. Also, if the wall of tubular section 35 is made too thin, it may lack sufficient compressive strength, and may buckle rather than radially expanding.

The applicants have discovered that the foregoing problems can be avoided by providing a thin radial web connection between tubular section 35 and annular outer portion 32 of flange 31. This functions to increase the effective length of tubular section 35 without substantially decreasing the peak force value provided by the section and without decreasing the compressive strength of the section. The result is modification of the force/deflection characteristic to that illustrated by curve 50 in FIG. 5. As can be seen, an adequate peak force is maintained while moving the breakover point of the curve to a higher deflection value in accordance with the force/deflection characteristic desired for keyboard applications.

The vertical dashed line in FIG. 5 represents the deflection at which actuator button 46 comes into contact with switching assembly 13. Except for the force required for distortion of cup shaped section 44 resulting from that contact, the force/deflection curve would follow dashed line 52. However, the reaction force provided by section 44 superimposes a force/deflection characteristic represented by curve 53 onto that of curve 50. The result is a force/deflection curve as indicated at 54 for larger deflections.

In accordance with the foregoing discussion, the applicants having provided a compact elastomeric push button return element which provides an enhanced force/deflection characteristic while meeting the other important requirements for a push button return element. Specifically, the applicants' design provides for a breakover point in the characteristic at a higher deflection than heretofore possible with prior return element designs. A specific embodiment has been shown and described in detail for illustrative purposes. However, it is not intended that the applicants coverage be limited to the illustrated embodiment, but only by the terms of the following claims.

The embodiments of the invention in which an exclusive property or right is claimed are defined as follows:

1. A resilient element for return biasing of a push button adapted for movement along an axis transverse to a mounting surface, the resilient element being formed of elastomeric material in a configuration comprising:

a tubular section extending along the axis, said tubular section having first and second ends and a predetermined wall thickness;

a flange having an outer portion with a lower surface to be held in contact with the mounting surface and an annular inner web portion extending radially with respect to the axis and joining the outer portion of said flange and the first end of said tubular section, the web portion having a lower surface which is continuous with the lower surface of the outer portion and having a thickness less than the wall thickness of said tubular section;

a hollow frustum section extending along the axis and having a large end joined to the second end of said tubular section and a small end more remote from the mounting surface than the large end; and a crown configured to connect the small end of said hollow frustum section to the push button.

2. The element of claim 1 wherein the wall thickness of said hollow frustum section varies between the large and small ends thereof.

3. The element of claim 2 wherein the wall thickness of said hollow frustum section is greater at the large and small ends than therebetween.

4. The element of claim 3 wherein said crown includes:

a shoulder at a predetermined radius from said axis against which the push button is positioned; and a stop member substantially at the predetermined radius within said hollow frustum section between said shoulder and the mounting surface for limiting movement of the push button toward the mounting surface.

5. The element of claim 4 wherein said crown further includes:

an actuator which assumes a position proximate an area on the mounting surface when the push button is depressed; and a resilient cup shaped section which carries said actuator.

6. The element of claim 5 wherein said stop member and said actuator are arranged so that the mounting surface is first contacted by said actuator and then by said stop member as the push button is depressed.

7. The element of claim 6 wherein said crown further includes a tubular wall adapted to snuggly fit into an aperture in the push button, said tubular wall being at a radius slightly smaller than the radius of said shoulder.

8. The element of claim 7 wherein the outer portion of said flange is of annular configuration and has a thickness along the axis greater than the thickness of the inner web portion.

9. A return element for imparting a desired tactile characteristic to a push button adapted for movement along an axis relative to a mounting surface, said return element being formed of an elastomeric material in a configuration comprising:

a hollow member extending along the axis, said hollow member including a first section having a predetermined diameter and a second section joined to the first section and having a diameter which decreases with distance along the axis;

a flange joined to the first section of said hollow member remote from the second section thereof, said flange being formed with an annular groove opening toward the second section of said hollow member at the junction between said flange and said hollow member so as to form a radially extending web connected to said hollow member, the first section of said hollow member and the web being characterized so that the web is more flexible than the first section; and a crown configured to connect the push button to the small diameter end of the second section.

10. The return element of claim 9 wherein the wall thickness of said first section is greater than the thickness of said web in a direction along the axis.

11. The return element of claim 10 wherein the portion of said flange excluding the web has a thickness along the axis greater than the thickness of the web.

12. The return element of claim 11 wherein the second section of said hollow member is a hollow frustum having a wall thickness which varies along the axis.

13. The return element of claim 12 wherein said hollow frustum is formed with a minimum wall thickness at an intermediate location along its length.

14. The return element of claim 13 wherein said crown includes:

a tubular wall of a diameter sized to fit snuggly into an aperture in the push button, the end of the wall nearest the mounting surface terminating in an outwardly extending shoulder against which an end of the push button is positioned when the push button is in place; and a stop member within said hollow member at a radius substantially equal to the radius of the shoulder on the tubular wall for limiting movement of the push button toward the mounting surface.

15. The return element of claim 14 further including:

an actuator for actuating an area on the mounting surface when the push button is depressed; and a resilient cup shaped section joining said actuator to said tubular wall.

16. The return element of claim 15 wherein said actuator, said cup shaped section and said stop member are arranged so that as said push button is depressed, the mounting surface is first contacted by said actuator and then by said stop member.

17. A push button assembly with enhanced tactile characteristics comprising:

a base having a mounting surface thereon;

a push button adapted for movement along an axis relative to said mounting surface; and an elastomeric return element extending along the axis between said mounting surface and said push button, said elastomeric return element being formed with an annular flange having lower surface in contact with said mounting surface, a hollow member including a first section having a predetermined diameter joined to said flange through a radially extending web characterized by greater flexibility than the first section, the web having a surface which is continuous with the lower surface of the flange, the hollow member further including a second section joined to the first section and having a diameter which decreases with distance along the axis away from said mounting surface, and a crown remote from said mounting surface connected to said push button.

18. The push button assembly of claim 17 wherein the first section of said hollow member has a wall thickness greater than the thickness of the web connecting the first section and the flange.

19. The push button assembly of claim 18 wherein the second section of said hollow member is configured as a hollow frustum joined at its large end to the first section and at its small end to the crown, said hollow frustum having a wall thickness which varies with location along the axis.

20. The push button assembly of claim 19 wherein the wall thickness of the hollow frustum is smallest in an area intermediate the ends of the frustum.

21. The push button assembly of claim 20 wherein:

said push button is formed with a cylindrical aperture extending along the axis;

said crown is formed with a tubular wall sized to fit snuggly into the aperture in said push button, said tubular wall terminating in an outwardly extending shoulder against which said push button is positioned; and said return element further includes an annular stop member having substantially the same radius as the shoulder on said tubular wall, said stop member being located within said hollow member between said tubular wall and said mounting surface for limiting movement of said push button toward said mounting surface.

22. The push button assembly of claim 21 wherein said return element further includes:

an actuator for contacting an area on said mounting surface when said push button is depressed; and a resilient cup shaped section carrying said actuator.

23. The push button assembly of claim 22 wherein said base includes an electrical switch adapted for actuation by depression of said push button.

* * * * *